US010475565B2

(12) United States Patent
Veenstra et al.

(10) Patent No.: US 10,475,565 B2
(45) Date of Patent: Nov. 12, 2019

(54) TRACTION TRANSFORMER

(71) Applicant: ABB Schweiz AG, Baden (CH)

(72) Inventors: Martin Veenstra, Lausanne (CH); Stephane Isler, Contamine sur Arve (FR); Toufann Chaudhuri, Morges (CH); Blaise Thorens, Geneva (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/666,104

(22) Filed: Aug. 1, 2017

(65) Prior Publication Data

US 2018/0075963 A1 Mar. 15, 2018

(30) Foreign Application Priority Data

Aug. 12, 2016 (EP) ..... 16184039

(51) Int. Cl.

| | |
|---|---|
| ***H01F 27/02*** | (2006.01) |
| ***H01F 27/12*** | (2006.01) |
| ***H01F 27/32*** | (2006.01) |
| ***H01F 27/28*** | (2006.01) |
| ***H01F 27/34*** | (2006.01) |

(52) U.S. Cl.

CPC ..... *H01F 27/12* (2013.01); *H01F 27/2876* (2013.01); *H01F 27/324* (2013.01); *H01F 27/34* (2013.01); *H01F 2027/348* (2013.01)

(58) Field of Classification Search

CPC ..... H01F 27/26; H01F 27/266; H01F 27/08
USPC ..... 336/90, 216
See application file for complete search history.

(56) References Cited

U.S. PATENT DOCUMENTS

| | | | | |
|---|---|---|---|---|
| 3,396,355 | A | 8/1968 | Hochart et al. | |
| 5,757,258 | A * | 5/1998 | Krichtafovitch | H01F 27/266 336/65 |
| 9,659,704 | B2 * | 5/2017 | Yang | H01F 17/0013 |

(Continued)

FOREIGN PATENT DOCUMENTS

| | | | |
|---|---|---|---|
| CN | 103035370 | A | 4/2013 |
| WO | 2014086948 | A2 | 6/2014 |

(Continued)

OTHER PUBLICATIONS

Kamijo H et al, Fabrication of Superconducting Traction Transformer for Railway Rolling Stock, Journal of Physics: Conference Series, Institute of Physics Publishing, Bristol, GB, vol. 43, No. 1, Jun. 1, 2006, pp. 841-844.

(Continued)

*Primary Examiner* — Ronald Hinson
(74) *Attorney, Agent, or Firm* — Taft Stettinius & Hollister LLP; J. Bruce Schelkopf

(57) ABSTRACT

A transformer which includes an enclosure with a first and second cover arranged at opposite ends of the enclosure, the enclosure having an enclosed volume filled with isolation material and including at least one channel which extends through the enclosure from the first cover to the second cover. The interior of each channel is separated from the enclosed volume, and the core is provided outside of the enclosed volume and comprises a leg and a yoke. The leg extends through the channel. The transformer further includes a coil inside the enclosed volume and being wound about the channel. The first and second cover each comprise an electrically insulating material and at least one electrically conductive component.

16 Claims, 4 Drawing Sheets

(56) References Cited

U.S. PATENT DOCUMENTS

| | | | | |
|---|---|---|---|---|
| 2013/0113597 | A1* | 5/2013 | Roy | H01F 27/26<br>336/84 C |
| 2016/0196927 | A1* | 7/2016 | Bryant | H01L 51/0037<br>136/244 |

FOREIGN PATENT DOCUMENTS

| | | | |
|---|---|---|---|
| WO | 2014086948 | A3 | 6/2014 |
| WO | 2016038222 | A1 | 3/2016 |

OTHER PUBLICATIONS

European Search Report, European Patent Application No. 16184039, dated Feb. 8, 2017, 6 pages.

Intellectual Property India, "English Translation of the Examination Report", dated May 15, 2019, pp. 1-5. The Indian Patent Office, Chennai, India.

* cited by examiner

TRACTION TRANSFORMER

TECHNICAL FIELD

The present invention relates to transformer assemblies, in particular transformer assemblies for high-power applications, such as for use in traction applications and the like.

BACKGROUND OF THE INVENTION

In traction applications, transformers are conventionally used for galvanic decoupling and transformation of electrical power. To provide high-power conversion, transformers need to be designed with a substantial size and weight. Due to the high power involved, cooling and insulation constraints are to be considered in the transformer design.

In order to meet the requirements of traction applications, traction transformers are usually encased in oil-filled tanks having forced oil circulation and forced air cooling. Due to the restricted heat dissipation through oil, the size and weight of the above kind of transformers cannot be further reduced.

Document CN 103035370 discloses an oil-immersed transformer device including a transformer disposed in a transformer tank. The transformer is mounted in the transformer tank. The transformer tank is filled with oil. A cooling duct for cooling the oil is provided in the transformer tank, wherein water is fed through the cooling duct.

Document WO 2014/086948 A2 discloses a transformer for traction applications with windings immersed in an oil filled enclosure. The closed loop core extends through the inner of a central inner cylinder element which forms part of the enclosure and is therefore not in contact with oil.

The known solutions leave room for improvement. In view of the above, there is a need for the present invention.

SUMMARY OF THE INVENTION

According to a first aspect, a transformer is provided. The transformer comprises an enclosure with a first cover and a second cover arranged at opposite ends of the enclosure, the enclosure having an enclosed volume filled with isolation material. The enclosure comprises at least one channel which extends through the enclosure from the first cover to the second cover, wherein the interior of each of the at least one channel is separated from the enclosed volume; the transformer further comprises a core provided outside of the enclosed volume, comprising at least one leg and at least one yoke, wherein the at least one leg extends through the interior of the at least one channel. The transformer further comprises at least one coil provided inside the enclosed volume and wound about the at least one channel. The first cover and the second cover each comprise an electrically insulating material and at least one electrically conductive component.

The transformer according to embodiments requires only a reduced amount of oil, or isolation material in general, in comparison to conventional transformers. Effects of the reduced quantity are reduced weight and lower environmental footprint. This is in part achieved by providing the transformer core entirely outside the enclosure for the isolation material, in the following shortly called oil. The windings are provided in the oil, because of the insulation requirements and to ensure proper cooling. As oil is a very good heat transfer medium and a good isolation material, the advantage of oil is clear compared to air-insulated, when a high power density and low weight is needed. The enclosure (or tank) of the transformer, which conventionally is a large oil tank, into which the transformer active parts are immersed, is in embodiments a type of envelope solely enclosing the windings. The enclosure is constructed such that the core can pass through it without being in contact with the oil. The inventors have found that the design and material choice for the covers according to embodiments described herein further improves the properties of such transformers. Apart from oil, also a number of other materials may be employed as an isolation material in embodiments.

Further aspects, advantages and features of the present invention are apparent from the dependent claims, their combinations, the description and the accompanying drawings.

BRIEF DESCRIPTION OF THE DRAWINGS

A full and enabling disclosure, including the best mode thereof, to one of ordinary skill in the art is set forth more particularly in the remainder of the specification, including reference to the accompanying figures wherein.

DETAILED DESCRIPTION OF THE INVENTION

Figure 1:
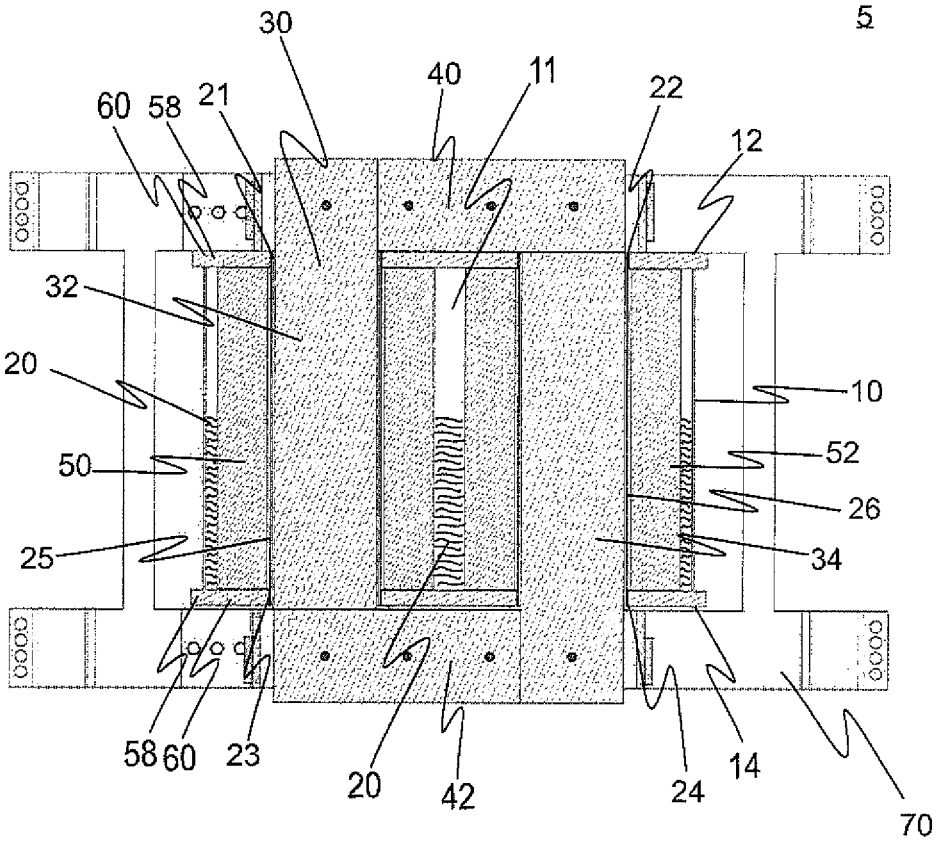
FIG. 1 schematically shows a cross-sectional view of a transformer according to embodiments.

Reference will now be made in detail to various embodiments, one or more examples of which are illustrated in each figure. Each example is provided by way of explanation and is not meant as a limitation. For example, features illustrated or described as part of one embodiment can be used on or in conjunction with other embodiments to yield yet further embodiments. It is intended that the present disclosure includes such modifications and variations.

Within the following description of the drawings, the same reference numbers refer to the same or similar components. Generally, only the differences with respect to the individual embodiments are described. When several identical items or parts appear in a figure, not all of the parts have reference numerals in order to simplify the appearance.

The systems and methods described herein are not limited to the specific embodiments described, but rather, components of the systems and/or steps of the methods may be utilized independently and separately from other components and/or steps described herein. Rather, the exemplary embodiment can be implemented and used in connection with many other applications.

Although specific features of various embodiments of the invention may be shown in some drawings and not in others, this is for convenience only. In accordance with the principles of the invention, any feature of a drawing may be referenced and/or claimed in combination with any feature of any other drawing.

Generally, embodiments described herein pertain to a transformer, which may be a traction transformer for rail vehicles, or generally a transformer for power conversion applications. The transformer is partially insulated and cooled by an isolation material, which is enclosed in an enclosure. The enclosure has at least one channel which extends through it, wherein a part of the transformer core, namely a leg (limb), extends through the channel. The respective winding is wound about the channel on the inside of the enclosure, such that the winding is in contact with the isolation material, typically a liquid or gel, inside the enclosure, and is spatially separated from the leg of the core located inside the channel. The enclosure has two covers on opposite sides thereof, the covers each having an opening forming the respective ends of the channel.

Embodiments described herein pertain to transformers having one (as described above), two, three, or even more channels extending through the enclosure. In each channel, a leg of the transformer core is located. Hence, in a transformer with one channel, at least one further leg of the transformer core is not extending through a channel and thus not through the enclosure, but extends on an outwardly oriented side face of the enclosure in parallel to the leg in the channel. Both windings are wound about the single channel in this embodiment.

In a further embodiment for use with three-phase electric power, the enclosure has three parallel channels, and three legs of the core are each located in the channels and connected by two yokes, or by more yokes in a delta or star arrangement of the transformer. In all embodiments described herein, the yokes are located on an outward side of the covers and extend in parallel to the covers.

The inventors have found that using an insulating material for the covers, such as a polymer, is technically viable for avoiding a strong heating of the covers by induced eddy currents. This is due to the fact that the covers would each—unintendedly—function as a short-circuit winding when they have a good conductivity, for example when made from metal. However, the inventors also found that the use of an insulating material for the covers may lead to other unintended consequences under some conditions. Namely, after switching off power, remaining free charges accumulated on the outside of the covers due to the electric field during the operation of the transformer can result in a static high voltage which may cause injury for example, if a human operator approaches the transformer even some time after switching off the transformer. Further, the accumulated charges on the outside of the cover may lead to an undesirable corona discharge versus other (grounded) elements of the transformer during operation, such as a steel frame of the transformer mounting or the like.

In order to address the identified issues, the inventors have found that the covers of the enclosure should—at least in a region largely surrounding the holes for the core legs—have a conductivity which is in a medium range between a conductor and an insulator. Differently said, the covers according to embodiments exhibit a kind of semi-conducting conductivity without comprising a classical semi-conducting material, such as e.g. silicon. In order to obtain this property, the covers as employed in embodiments comprise an insulating material, typically a polymer, for example an epoxy resin, and have an additional component which is electrically conducting. This conducting component enhances the conductivity of the cover to a level which is defined to satisfy the following conditions: The conductivity is high enough in order to allow surface charges to be transported to at least one ground contact and thus to be removed. On the other hand, the conductivity shall be low enough in order to minimize the heating up of the cover by induced eddy currents. Further below, a number of possible variants for realizing the electrically conductive component is provided.

Thereby, it is understood that the conditions for an increase of the temperature of a cover due to eddy currents strongly vary with a number of constructional and operational parameters, e.g. size of the cover, thickness, cooling, ventilation, intensity of the magnetic flux during operation, and the like. Hence, there can only be provided a rough estimation for the threshold value for the heating of the covers, resulting in an estimation for the acceptable eddy current in the cover, and thus a resulting conductivity of the cover for a given transformer design. One concept for a threshold value can be provided in that the heating of a single cover due to eddy currents shall not exceed 1 kW, or in particular shall not exceed 500 W. Another favourable kind of threshold value may be provided in that the conductivity is chosen so that a heating of the cover to a temperature of above 150° C. is avoided in any operational state of the transformer. It is understood that the concrete dimensioning and construction of the covers as described herein by the threshold values can be done by means of e.g. numerical simulation, on the basis of the disclosure provided herein.

In FIG. 1, a cross-sectional view on a transformer 5 according to embodiments is shown. The transformer 5 comprises an enclosure 10 with a first cover 12 and a second cover 14 arranged at opposite ends of the enclosure 10. The enclosure 10 has an enclosed volume 11 filled with isolation material 20. The isolation material 20 may typically be an oil, but can also be a gel or a solid isolation material with sufficient conductivity for heat. In the embodiment of FIG. 1, the enclosure 10 comprises two channels 25, 26 (the number of channels varies in other embodiments) which extend through the enclosure 10 from the first cover 12 to the second cover 14. The interior of each of the channels 25, 26 is separated from the enclosed volume 11. The transformer 5 comprises a core 30 which is provided entirely outside of the enclosed volume 11 and is separated therefrom. The transformer 5 comprises two legs 32, 34 and two yokes 40, 42. The legs 32, 34 extend through the interior of the channels 25, 26 and thus extend through the enclosure 10 without being in contact with the enclosed volume 11. The transformer 5 further comprises two coils 50, 52 provided inside the enclosed volume 11. The coils 50, 52 are wound about the channels 25, 26 and are thus in contact with the isolation material 20 inside the enclosed volume 11. The coils 50, 52 are separated from the legs 32, 34 by the walls of the channels 25, 26. The enclosure 10 and the core 30 are mounted to a steel beam structure 70.

In the embodiment, the first cover 12 has two openings 21, 22, and the second cover 14 has two openings 23, 24. The openings 21, 22; 23, 24 are located at the respective ends of the channels 25, 26. The legs 32, 34 of the core 30 pass through the two covers 12, 14 via the openings. Generally, transformers described herein have a first cover 12 and a second cover 14, which are in the following also similarly referred to as "the covers 12, 14" and the like.

Figure 2:
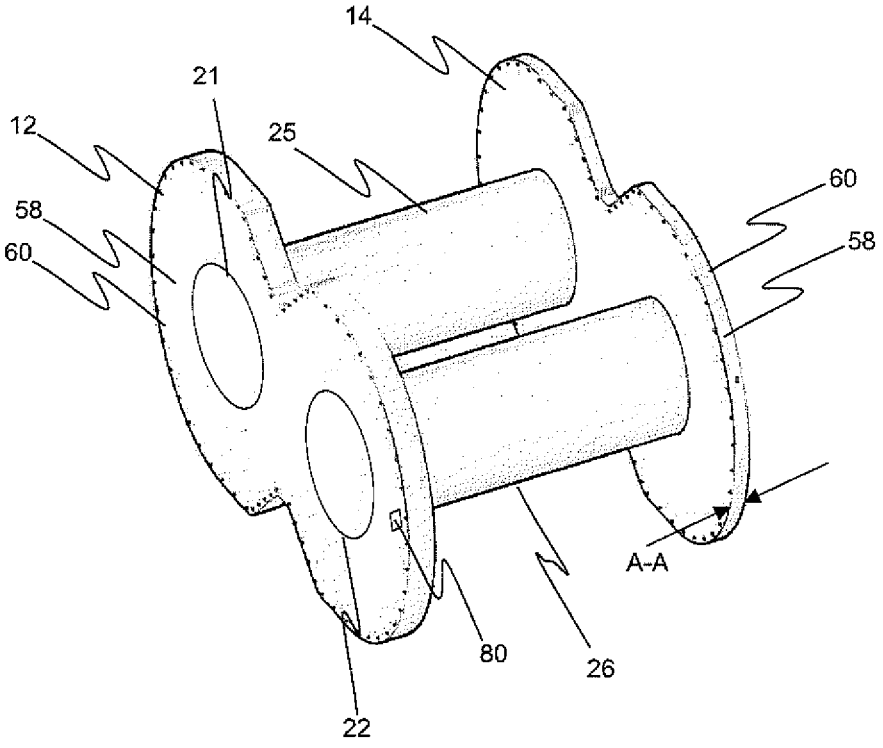
FIG. 2 schematically shows a perspective schematic view on a part of an enclosure of the transformer of FIG. 1.

FIG. 2 shows a part of the enclosure 10 as shown in FIG. 1, comprising the covers 12, 14 and the two channels 25, 26. Through the openings 21, 22, the legs 32, 34 (not shown in FIG. 2, see FIG. 1) of the transformer 5 extend out of the enclosure 10. The covers 12, 14 each comprise an electrically insulating material 58 and at least one electrically conductive component 60 in order to provide a defined conductivity which is high enough to enable free charges on the covers to flow to at least one ground contact 80 per cover. At the same time, the conductivity is designed to be low enough to minimize the heating of the covers 12, 14 via eddy currents. In FIG. 1 and FIG. 2, this electrically conductive component 60 is only schematically shown to be part of covers 12, 14, as it can be realized in a variety of ways in embodiments. Various realizations of the conductive component 60 are described in detail with respect to FIG. 3 to FIG. 7 below.

In FIG. 3 to FIG. 7, various variants are shown as partial cross-sectional views along A-A in FIG. 2—as to how the covers 12, 14 may be provided according to embodiments. It is understood that the skilled person may find other variants, based on the embodiments disclosed herein. Those variants are also regarded to fall under the scope of the present disclosure.

Generally, in embodiments described herein, the electrically conductive component 60 of the covers 12, 14 may be realized by different techniques. The covers 12, 14 generally comprise an electrically insulating material 58 as a main component or as basic material. In embodiments, this may be a polymeric material, such as a fiber-enforced resin, a carbon-fiber enforced resin, or any polymer providing sufficient mechanical stability. A well-known electrically insulating material 58 is epoxy resin or fiber-enforced epoxy resin. The electrically conductive component 60 can be added to this electrically insulating material 58 in a variety of ways, in particular as described in embodiments relating to FIG. 3 to FIG. 7 below. Thereby, the parameters and dimensioning of the electrically conductive component 60 may be varied depending on the individual parameters of the specific use case. Some basic aspects for respective dimensioning calculations are provided further below.

Figure 3:
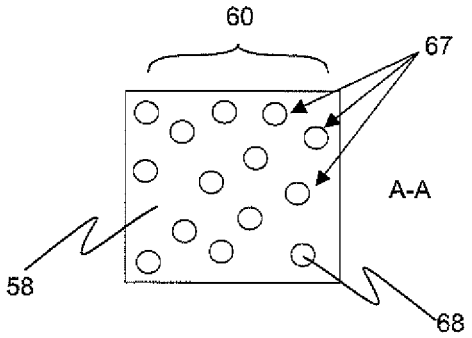
FIG. 3 to FIG. 7 show partial cross sectional views through sections of various covers as employed in FIG. 1 and FIG. 2.

FIG. 3 shows a cross-sectional view through a cover 12, 14 according to embodiments, wherein the electrically conductive component 60 comprises a matrix 67 of conducting particles 68, which are embedded in the electrically insulating material 58. For example, the conducting particles 68 may be (alternatively or in any combination(s)) microscopic metal particles, metal stripes, carbon particles, carbon nanotubes, or the like. The technique of adding conducting material 68 to an otherwise insulating basic material 58 to enhance conductivity is known as such only from other fields of engineering, for example under the term "carbon black".

Figure 4:
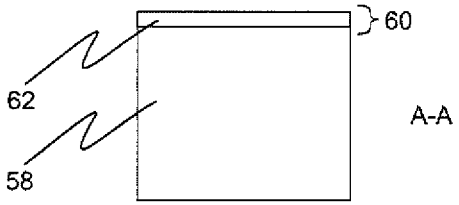

FIG. 4 shows a cross-sectional view through a cover 12, 14 according to embodiments, wherein the electrically conductive component 60 comprises generically a conductive layer 62 provided on one of its surfaces. This is preferably the surface of the cover 12, 14 facing outwardly from the transformer 5 and thus away from the respective other cover 12, 14.

Figure 5:
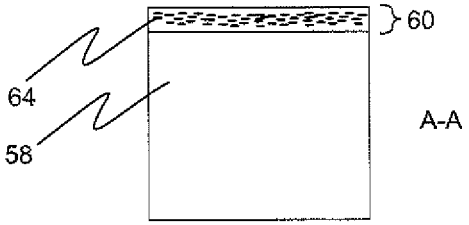

FIG. 5 shows a cross-sectional view through a cover 12, 14 according to embodiments, wherein the electrically conductive component 60 comprises a layer of a conductive paint 64, in particular a conductive paint coating 64. Such conductive paints 64 are available as stock products with varying values of specified conductivity. The required thickness of the conductive paint coating 64 can be calculated by using the herein disclosed design goals, as provided further below, using the specific conductivity of the paint 64 as provided by, e.g., the manufacturer. If a further layer of a different paint is provided on the conductive paint coating 64, i.e. for protection purposes, there should be left out at least one small area for the ground contact 80 (see FIG. 2), for contacting the conductive paint layer 64. Similar measures may be applicable in other embodiments described herein.

Figure 6:
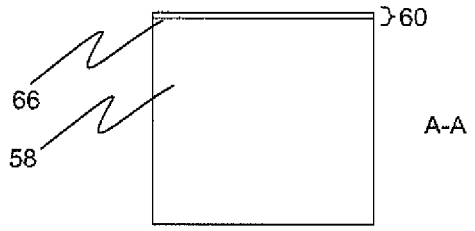

FIG. 6 shows a cross-sectional view through a cover 12, 14 according to embodiments, wherein the electrically conductive component 60 comprises a thin film metal coating 66. The thin film metal coating 66 may be applied to the electrically insulating material 58 of the cover 12, 14 by known processes, such as e.g. sputtering, electro-chemical processes, or other methods. In a variant of the above, a metal film 66 may be provided as stripes which extend in parallel to each other along the face of the cover 12, 14. For example, these stripes may be realized as metal tape stripes of 0.2 cm to 2 cm width each, that are provided with 1 mm to 5 mm distance from each other (i.e. from nearest neighbouring stripes). As the stripes do not form a closed loop around the transformer leg 32, 34, eddy currents are thus efficiently avoided.

Figure 7:
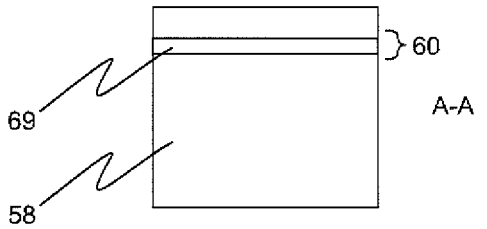

FIG. 7 shows a cross-sectional view through a cover 12, 14 according to embodiments, wherein the electrically conductive component 60 comprises a metallic grid 69, which is embedded in the electrically insulating material 58. The grid 69 may also be coated to a face of the electrically insulating material 58.

When the grid 69 is embedded in the insulating material 58, the distance to one face of the cover 12, 14 is preferably at least about three times larger than the distance to the other face of the respective cover 12, 14, even more preferably more than four times larger. Thereby, the larger distance is located on the side facing the respective other cover 14, 12, i.e. the larger distance is located on an inner side of the respective cover 12, 14 facing the enclosure 10 and the shorter distance is located on an outer side oriented away from the enclosure 10.

Generally, the covers 12, 14 of embodiments as described herein exhibit an electrical resistance from about 0.1 Ohm to about 1 MOhm, more preferably from 1 Ohm to 100 kOhm, along their greatest dimension, i.e. along the longitudinal axis of the cover 12, 14. Thereby, the conductivity of the covers 12, 14 is provided by design such that a local heating of the covers via eddy currents is kept below a threshold value, which may for example be chosen to be 1 kW per cover or more preferably 500 W per cover. Also, it has been shown that a heating of the cover 12, 14 above a temperature of 150° C. shall be avoided, which can also be taken as an alternative threshold parameter for the dimensioning of the conductivity of the covers 12, 14. On the other hand, static charge accumulation can be minimized by providing a resistivity as low as possible. In particular, the resistivity shall be chosen such that accumulated charges can be removed via grounding of the covers 12, 14 within a given time constant that allows proper handling of the transformer 5 e.g. by maintenance personnel. Thus, the concrete dimensioning of the electrically conductive component 60 of the covers 12, 14 includes a trade-off between minimizing the heating via eddy currents, while allowing for a good grounding of the whole surface of the covers 12, 14 for the reasons cited herein.

This written description uses examples to disclose the invention, including the best mode, and also to enable any person skilled in the art to practice the invention, including making and using any devices or systems and performing any incorporated methods. While various specific embodiments have been disclosed in the foregoing, those skilled in the art will recognize that the spirit and scope of the claims allows for equally effective modifications. Especially, mutually non-exclusive features of the embodiments described above may be combined with each other. The patentable scope of the invention is defined by the claims, and may include other examples that occur to those skilled in the art. Such other examples are intended to be within the scope of the claims, if they have structural elements that do not differ from the literal language of the claims, or if they include equivalent structural elements with insubstantial differences from the literal language of the claims.

The invention claimed is:

1. A transformer, comprising:

an enclosure with a first cover and a second cover arranged at opposite ends of the enclosure, having an enclosed volume comprising an isolation material, the enclosure comprising at least one channel which extends through the enclosure from the first cover to the second cover, wherein the interior of each of the at least one channel is separated from the enclosed volume, a core provided outside of the enclosed volume, comprising at least one leg and at least one yoke, wherein the at least one leg extends through the interior of the at least one channel, at least one coil provided inside the enclosed volume and being wound about the at least one channel, and wherein the first cover and the second cover each comprise an electrically insulating material and at least one electrically conductive component; and wherein the electrically conductive component comprises at least one of the following:

a layer of conductive material;

a conductive paint coating or a thin film metal coating;

a matrix of conducting particles, which is embedded in the electrically insulating material;

a metallic grid, which is embedded in the electrically insulating material or which is coated on a surface of the electrically insulating material; and wherein the at least one electrically conductive component of the first cover and the at least one electrically conductive component of the second cover are each grounded via at least one ground contact per cover, each of the electrically conductive components thereby grounding a whole surface of each of the first and second covers.

2. The transformer of claim 1, wherein the first cover and the second cover exhibit an electrical resistance selected in a range from 0.1 Ohm to 1 MOhm along their greatest dimension.

3. The transformer of claim 1, wherein the conductivity of the first cover and the conductivity of the second cover keep a local heating of the first cover and of the second cover via eddy currents below 1 kW and avoid heating the first and second covers above 150° C., while at the same time the conductivity of the first cover and the conductivity of the second cover avoid static charge accumulation by providing grounding for the first cover via the at least one electrically conductive component and the respective ground contact and by providing grounding for the second cover via the at least one electrically conductive component and the respective ground contact.

4. The transformer of claim 1, wherein the electrically insulating material of the first cover and of the second cover comprises a polymer.

5. The transformer of claim 1, wherein the electrically insulating material of the first cover and of the second cover comprises a fiber-enforced resin.

6. The transformer of claim 1, wherein the electrically conductive component of the first cover and of the second cover comprises at least one of: a conductive paint, a metal layer, a metal grid, metal particles, metal stripes, carbon particles, and carbon nanotubes.

7. The transformer of claim 1, wherein the at least one channel is defined by having two channels, wherein the isolation material is an oil.

8. The transformer of claim 1, further comprising a steel beam structure for mounting the transformer to a solid structure.

9. The transformer of claim 8, wherein the yokes are mounted to the steel beam structure.

10. The transformer of claim 1, wherein the transformer is a traction transformer configured for a railway vehicle.

11. The transformer of claim 1, wherein the distance of the metallic grid to one face of the first cover facing the second cover is at least three times larger than the distance to the other face of the first cover and/or the distance of the metallic grid to one face of the second cover facing the first cover is at least three times larger than the distance to the other face of the second cover.

12. The transformer of claim 1, wherein the electrically conductive component comprises a conductive paint coating or a thin film metal coating.

13. The transformer of claim 1, wherein the conductive paint coating or the thin film metal coating is defined by a plurality of parallel distinct stripes.

14. The transformer of claim 1, wherein the at least one electrically conductive component comprises a matrix of conducting particles, which is embedded in the electrically insulating material.

15. The transformer of claim 1, wherein the at least one electrically conductive component comprises a matrix of conducting particles, which is embedded in the electrically insulating material.

16. The transformer of claim 1, wherein the core is not in contact with the isolation material.

* * * * *